US005124959A

United States Patent [19]

Yamazaki et al.

[11] Patent Number: 5,124,959

[45] Date of Patent: Jun. 23, 1992

[54] HOUR CHIME CLOCK

[75] Inventors: Hiroshi Yamazaki; Teruo Takane; Kenji Oshima; Shigeru Shimozono; Shinya Tamura; Kunio Hashimoto, all of Tokyo, Japan

[73] Assignee: Seikosha Co., Ltd., Japan

[21] Appl. No.: 427,611

[22] Filed: Oct. 27, 1989

[30] Foreign Application Priority Data

Oct. 27, 1988 [JP] Japan ..... 63-271269

[51] Int. Cl.[5] ..... G04B 19/16

[52] U.S. Cl. ..... 368/231; 368/223; 368/272; 368/273

[58] Field of Search ..... 368/272-274, 368/223, 230-231, 229

[56] References Cited

U.S. PATENT DOCUMENTS 401,697 4/1889 Ethridge ..... 368/231
1,999,126 4/1935 Gardner ..... 368/231
3,404,527 10/1968 Tripet et al. ..... 368/231

FOREIGN PATENT DOCUMENTS 3806561 9/1988 Fed. Rep. of Germany ..... 368/229
0526046 5/1955 Italy ..... 368/231
0026978 12/1931 Netherlands ..... 368/231

*Primary Examiner*—Bernard Roskoski
*Attorney, Agent, or Firm*—Bruce L. Adams; Van C. Wilks

[57] ABSTRACT

An hour chime clock has an hour-indicating hand and a plurality of display units disposed circumferentially around the hour-indicating hand at different hour positions. The display units are displaceable between two positions to display either an ornament or an hour numeral. At each hour, a melody chimes and the display units undergo a predetermined pattern of movements. After chiming the hour, the display unit at the present hour position is placed in a different display state from the display state of all the other display units.

4 Claims, 3 Drawing Sheets

HOUR CHIME CLOCK

BACKGROUND OF THE INVENTION

The present invention is directed to an hour chime clock having a function to chime hours.

One arrangement of well-known hour chime clocks is that wherein hours are visually informed by displaying means which chiefly use ornaments such as dolls making motions when chiming the hours.

The displaying means of the prior art hour chime clock function simply to attract one's attention by exhibiting ornamental effects.

SUMMARY OF THE INVENTION

Accordingly, it is a primary object of the present invention, which is devised to obviate the foregoing problems inherent in the prior art, to provide an hour chime clock capable of permitting displaying means thereof to exhibit greater effects in connection with the indicated hour in addition to the ornamental effects.

DETAILED DESCRIPTION OF THE INVENTION

Figure 1:
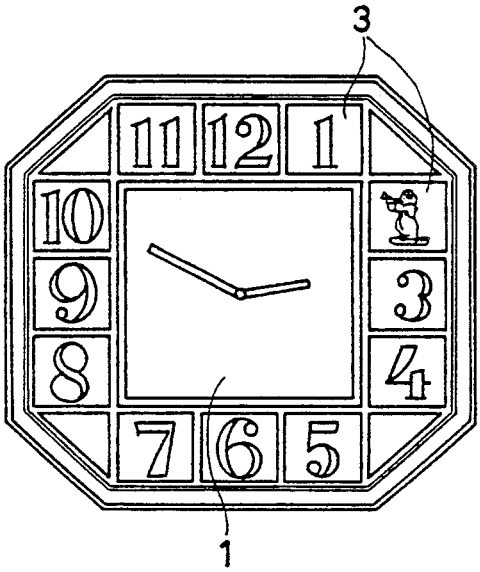
FIGS. 1(A), 1(B) and 1(C) are diagrams illustrating an external appearance of an hour chime clock of the present invention, for use in explaining the operations in one embodiment of the invention.
Figure 1:
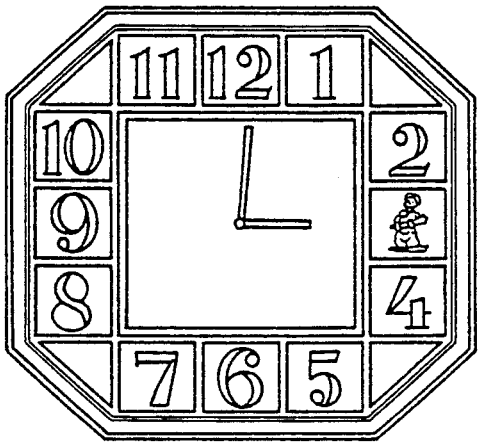
Figure 1:
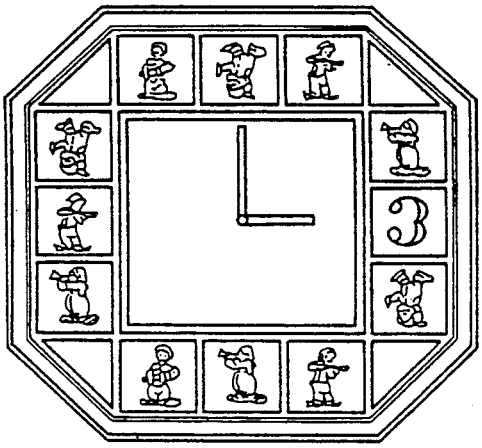
Figure 2:
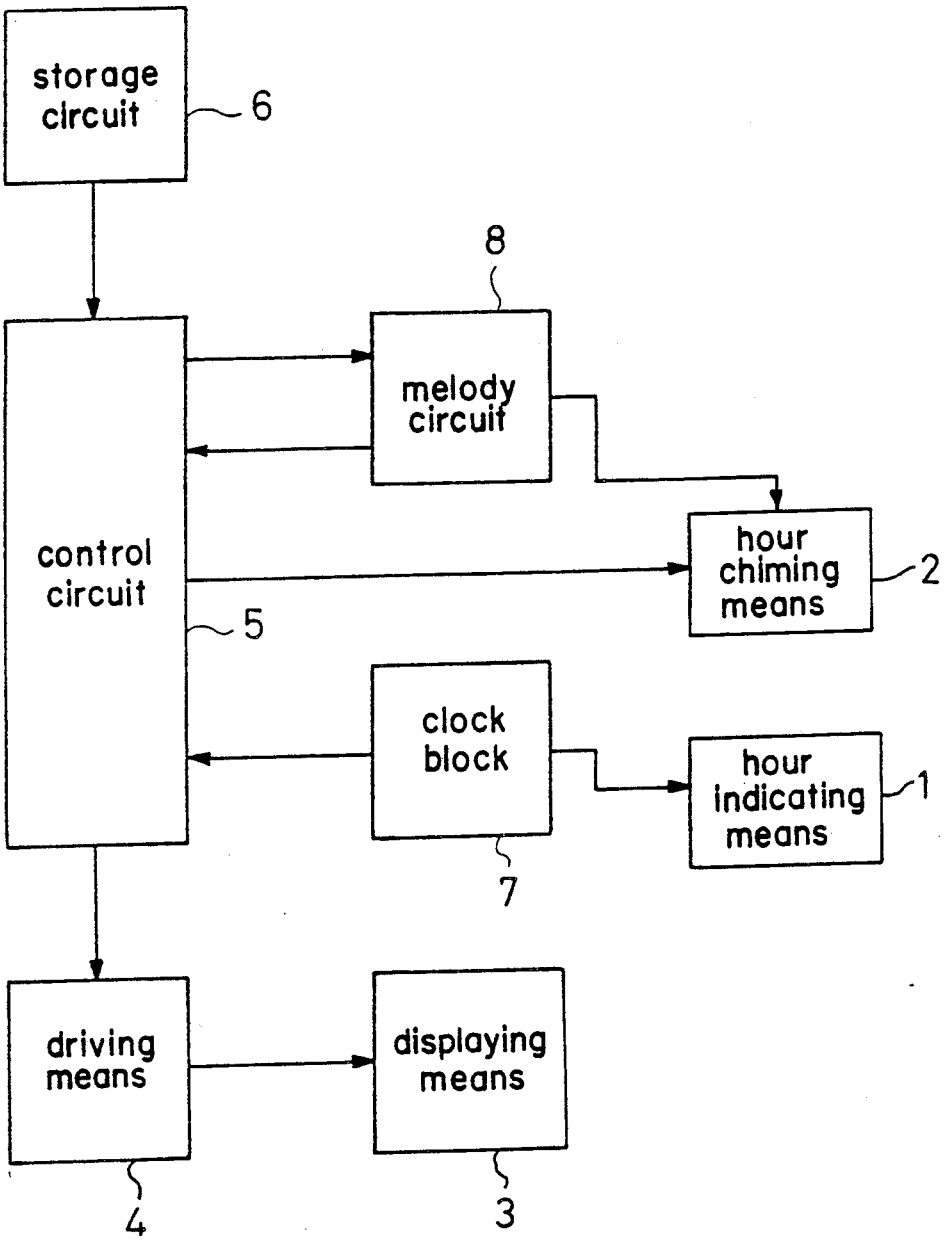
FIG. 2 is a block diagram thereof.

Turning first to FIGS. 1 and 2, an hour indicating means generally designated at 1 in FIG. 1(A), which may be classified as a pointer type in this embodiment, serves to indicate hours on the face of the clock. Denoted at 2 is an hour chiming means, consisting of a speaker or the like in this embodiment, for chiming at least hours. The numeral 3 represents a plurality of displaying means disposed along the circumference of the hour indicating means 1 as shown in FIG. 1(A), corresponding to hour indicating positions, the displaying means being composed of displaceable hour displaying units marked with hour numerals and ornaments such as dolls or the like concealed behind the hour displaying units in this embodiment. Each displaying unit is displaceable to either an hour display state in which the hour numeral is visible and the ornament is concealed or an ornamental display state in which the ornament is visible and the hour numeral is concealed. Designated at 4 is a driving means for controlling displaying modes by driving respective hour displaying means 3 with outputs of a control circuit 5.

Figure 3:
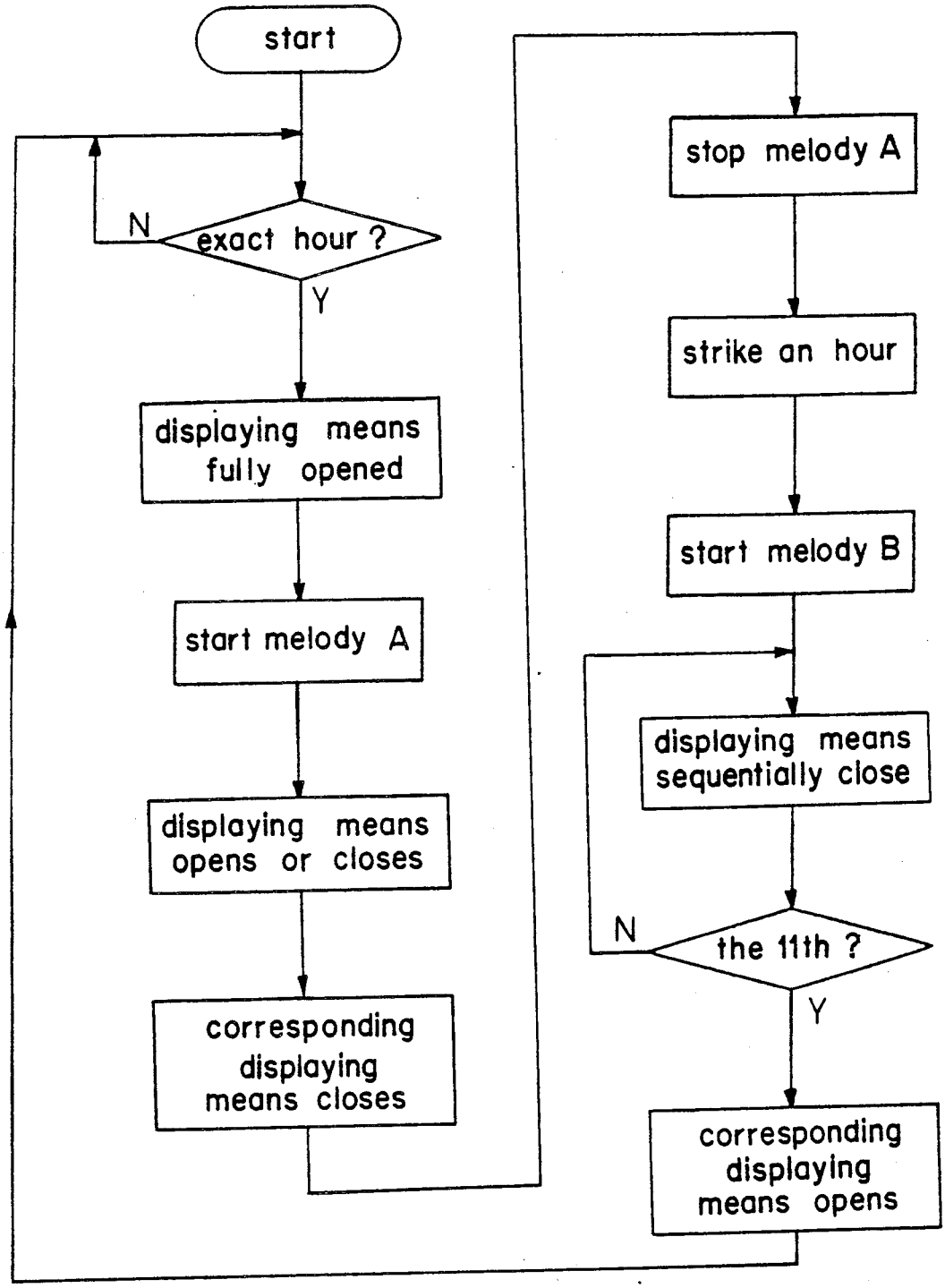
FIG. 3 is a flow chart thereof.

The operation of the clock of the present invention will now be described in accordance with the flow chart shown in FIG. 3 and with reference to FIGS. 1 and 2.

In the usual time zone in which no hour is chimed, the hour indicating means 1 indicates the present hour and minute time in correspondence to the state of the clock block 7 of FIG. 2. In this case, as shown in FIG. 1(A), only the displaying means 3 at the indicating position ( i.e., "2" o'clock position) corresponding to the hour indicated by the hour indicating means 1 is open. That is, only the displaying means 3 at the indicating position corresponding to the hour indicated by the hour indicating means 1 is placed in the ornamental display state and displays an ornament while all the remaining displaying means 3 are placed in the hour display state and display hour displaying units.

When any of the hours (3 o'clock in the instant example) is on, a signal is transmitted from the clock block 7 of FIG. 2 to a control circuit 5 and in response thereto, the control circuit 5 generates a signal to the driving means 4 so that all the displaying means 3 are closed by a drive signal from the driving means 4 allowing all the hour displaying units to be displayed.

Subsequently, a melody A start signal is transmitted from the control circuit 5 to a melody circuit 8, and the hour chiming means 2 makes melodies corresponding to respective hours in response to melody signals transmitted from the melody circuit 8. At this time, the respective hour displaying means 3 perform a variety of attractive opening/closing motions or displacement patterns in response to driving signals sent from the driving means 4 on the basis of data stored in a memory circuit 6.

Upon completion of the various attractive opening/-closing motions or displacement patterns of the respective hour displaying means 3, as illustrated in FIG. 1(B), there closes the hour displaying means alone in an hour indicating position (associated with "3" in the same Figure) corresponding to the hour indicated by the hour indicating means 1. More specifically, only the hour displaying means 3 in the hour indicating position corresponding to the hour indicated by the hour indicating means 1 is placed in the hour display state and exhibits the hour indicating unit, while the other displaying means 3 are placed in the ornamental display state and exhibit the ornaments.

After finishing the melody A, a melody A stop signal is transmitted from the melody circuit 8 to the control circuit 5. An hour chime signal is sent from the control circuit 5 to the hour chiming means 2 in response to the melody A stop signal, whereby the hour chiming means 2 strikes the hour a predetermined number of times.

Next, the control circuit 5 transmits a melody B start signal to the melody circuit 8 which in turn gives forth a melody signal. The hour chiming means 2 produces a given melody in accordance with the melody signal therefrom. At this time, the respective hour displaying means 3 subsequent to the already closed hour displaying means 3 ("3" o'clock position in this embodiment) are sequentially closed (11 pieces of displaying means 3 are closed in due order such as: 4, 5, . . . 12, 1 and 2 in this embodiment). Finally all the hour displaying means 3 are closed That is, all the hour displaying means 3 exhibit the hour displaying units.

Subsequently, as depicted in FIG. 1(C), there opens only the hour displaying means 3 in an hour indicating position (associated with "3" in the same Figure) corresponding to the hour indicated by the hour indicating means 1. To be more specific, the hour displaying means 3 alone in the hour indicating position corresponding to the hour indicated by the hour indicating means 1 shows its ornament, while the other displaying means 3 exhibit the hour displaying units.

Upon completion of the above-described operations, the displaying means 3 keeps a mode depicted in FIG. 1(C) till the next hour comes.

In connection with the step, as discussed in the foregoing embodiment, sequentially closing the displaying means, it may be possible that the displaying means 3 are sequentially reversed from that disposed in the hour indicating position (associated with "3" in the same Figure) corresponding to the hour indicated by the hour indicating means 1 (in this embodiment, the displaying means 3 indicating "3" is at first opened, and then "4", "5", . . . , "12", "1" and "2" are closed in due order, thus reversing totally the 12 pieces of displaying means 3 in sequence). Eventually, there opens only the displaying means 3 disposed in the hour indicating position (associated with "3" in the same Figure) corresponding to the hour indicated by the hour indicating means 1, whereas all the other displaying means 3 may be closed.

The opening/closing modes of the displaying means 3 in the hour indicating position associated with the hour indicated by the hour indicating means and of the other displaying means 3 may properly be set at motions in reverse to the above-mentioned embodiment.

In accordance with the embodiment discussed above, there may be provided a sensor for detecting ambient brightness of the clock. A luminary means may also be provided to brighten only the displaying means 3 disposed in the hour indicating position corresponding to the hour indicated by the hour indicating means during the night on the basis of an output of the sensor.

In the above-mentioned embodiment, the hour indicating means may include a digital type, and 24 pieces of displaying means may also be incorporated for adaptation to a 24-hour basis clock.

The melody A starts emitting at every exact hour in the foregoing embodiment. It may, however, be possible to start striking at each hour.

In the embodiment given above, the display modes of the displaying means are sequentially reversed, starting from the displaying means disposed in the hour indicating position corresponding to the hour indicated by the hour indicating means or alternatively from the next displaying means after chiming the hour. The reverse operation may, however, be effected at random.

Although the displaying means in the foregoing embodiment are composed of hour displaying units marked with the hour numerals with the ornaments concealed behind the hour displaying units, a wide variety of modifications other than this arrangement may be made The requirement is that the displaying means are driven so as to exhibit different display mode of the displaying means in the hour indicating position associated with the hour indicated by the hour indicating means from the other display mode of the displaying means in other hour indicating positions while the hour chiming means chimes the hour. The displaying means involves the use of, e.g., a doll assuming a three dimensional configuration, the arrangement being such that dynamic and static modes of the displaying means correspond to opening/closing states of the displaying means in the foregoing embodiment.

In the aforementioned embodiment, the melodies A start sounding at exact hours. It is, however, possible to begin striking the exact hours.

According to the present invention, the display mode of the displaying means in the hour indicating position associated with the hour indicated by the hour indicating means is made different from the other display mode of the displaying means in other hour indicating positions. With this arrangement, the displaying means exhibit a new function to visually inform the present time as well as having the ornamental function, whereby enhancing the clock functions more remarkably than in the prior art.

In the case of sequentially reversing the display modes of the displaying means starting from the one disposed in the hour indicating position corresponding to the hour indicated by the hour indicating means or from the next displaying means after chiming the hour, there are exhibited useful effects other than those associated with the foregoing functions with respect to the hour chime clock performing the attractive motions, wherein the user is capable of recognizing that a series of motions of the displaying means are finished by sequentially reversing the display modes of the displaying means.

We claim:

1. A clock comprising: a clock face; hour indicating means on the clock face for visually indicating the present hour; means for audibly indicating the present hour when the hour indicating means indicates the present hour; display means disposed at each hour position around the clock face and switchable at each hour position between at least first and second display modes; and means for switching the display means at the present hour position into the first display mode and the display means at the other hour positions into the second display mode during the audible indication of the present hour.

2. A clock according to claim 1; wherein the first display mode comprises an hour marker corresponding to the hour position and the second display mode comprises an ornament.

3. A clock according to claim 1; wherein the switching means includes means for sequentially reversing the display modes of the display means from the first mode to the second mode and from the second mode to the first mode after the audible indication of the current hour.

4. A clock according to claim 3; wherein the first display mode comprises an hour marker corresponding to the hour position and the second display mode comprises an ornament.

* * * * *